US006104350A

United States Patent [19]

Ng et al.

[11] Patent Number: 6,104,350

[45] Date of Patent: Aug. 15, 2000

[54] RETRACTABLE ANGLED ANTENNA ASSEMBLY

[75] Inventors: Phoebe Ng, Sunrise; Alessandro Perrotta, Ft. Lauderdale, both of Fla.

[73] Assignee: Motorola, Inc., Schaumburg, Ill.

[21] Appl. No.: 09/274,040

[22] Filed: Mar. 22, 1999

[51] Int. Cl.[7] ..... H01Q 1/24

[52] U.S. Cl. ..... 343/702; 343/805; 343/874

[58] Field of Search ..... 343/805, 806, 343/807, 874, 888, 889, 901; 455/575, 90

[56] References Cited

U.S. PATENT DOCUMENTS

| | | | |
|---|---|---|---|
| 3,624,662 | 11/1971 | Feder | 343/715 |
| 4,725,845 | 2/1988 | Phillips | 343/702 |
| 5,138,329 | 8/1992 | Saarnimo et al. | 343/702 |
| 5,343,213 | 8/1994 | Kottke et al. | 343/702 |
| 5,559,522 | 9/1996 | Seitz | 343/702 |
| 5,590,416 | 12/1996 | Rydbeck | 455/90 |
| 5,739,793 | 4/1998 | Adachi | 343/702 |

*Primary Examiner*—Don Wong
*Assistant Examiner*—James Clinger
*Attorney, Agent, or Firm*—M. Mansour Ghomeshi

[57] ABSTRACT

An antenna assembly includes a straw having a substantially linear passageway and a helix base coil with an angled tapered guide, the passageway having a width wider than the widest portion of the angled tapered guide. An antenna element has a stopper portion and a straw. For a vertical retraction and a slanted extension, the antenna element is movable between a slanted position wherein the antenna element is inclined from the housing when the stopper of the antenna element is positioned inside the angled tapered guide of the base coil and a retracted position substantially within the straw inside the radio housing wherein the antenna element is retracted vertically within the straw.

19 Claims, 10 Drawing Sheets

RETRACTABLE ANGLED ANTENNA ASSEMBLY

TECHNICAL FIELD

This invention relates to antennas, and more specifically to a retractable or collapsible antenna assembly.

BACKGROUND

In many radio communication applications, such as radios, cellular phones, the likes and their combinations, it becomes necessary to be able to reliably lower the communication device's antenna to reduce the size of the overall communication device. After the antenna is extended as a straight antenna, placed close to the user's head, as in a typical handphone usage, the close proximity of the extended straight antenna loads down the antenna's performance and reduces the antenna's gain.

When the communication device such as a radio and phone combination is used to make a phone call, the user brings the device next to his/her left or right ear and extends the device's antenna. Typical retractable antennas are designed in such a way that the antenna comes out of the radio straight up. The proximity of the user's head to the antenna has shown to degrade antenna performance considerably due to the antenna loading effect. In order to reduce the loading effects and therefore improve antenna efficiency it would be preferable to have the antenna tilted away from the user's head.

Some phone manufacturers have come up with a design to tilt the antenna by actually molding the antenna boss in an already tilted angle. A canted, tilted, or otherwise positioned antenna, angled away from the user's head, enabled by an angled antenna boss, has better gain characteristics as seen in U.S. Pat. No. 5,590,416. However, this solution presents several mechanical challenges as far as the interface required internally to providing the bending of the antenna without breakage and deformation to the antenna assembly. Furthermore, the angled boss design maybe objectionable to the user because of the sharp corner or otherwise bent physical appearance of such a canted antenna.

A need, therefore, exits for an antenna assembly which can overcome the above mentioned problems associated with present day radio antenna assemblies, without sacrificing aesthetics or mechanical reliability.

DETAILED DESCRIPTION OF THE PREFERRED EMBODIMENT

Figure 1:
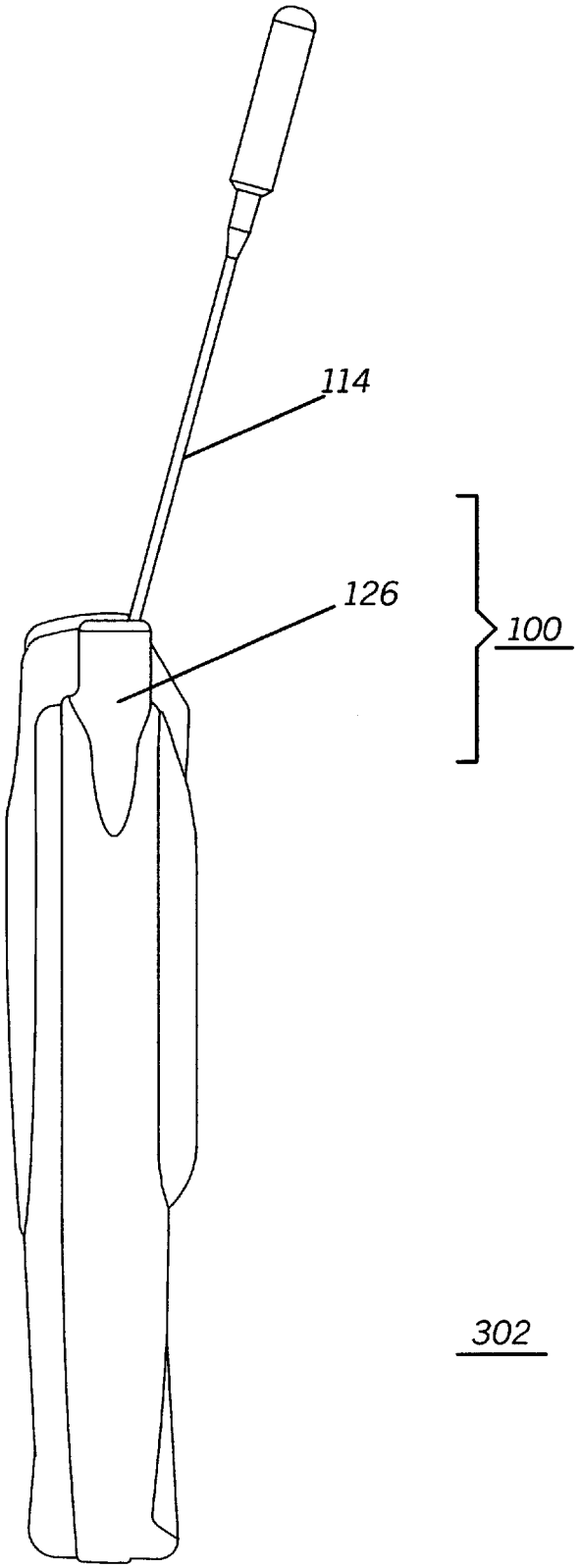
In FIG. 1 a communication device having an antenna assembly in accordance with the present invention is shown.
Figure 2:
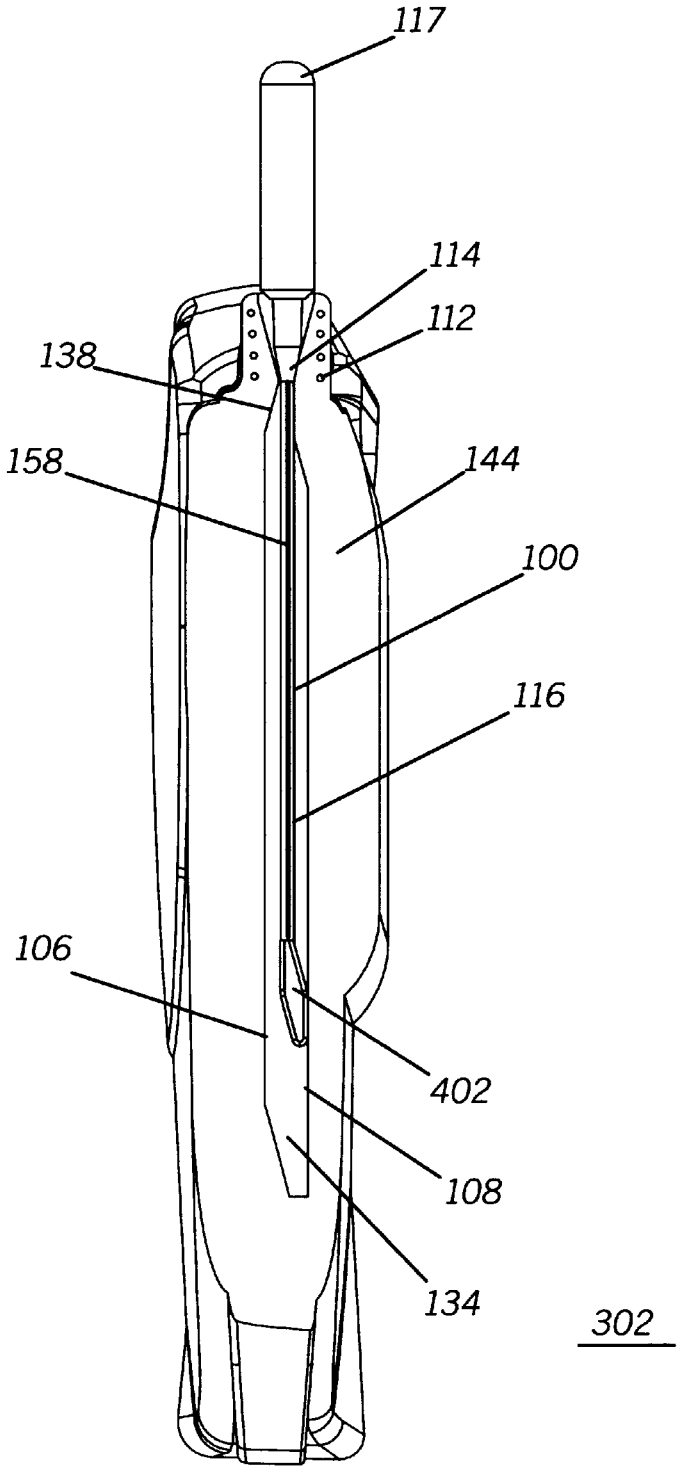
In FIG. 2 the same antenna assembly as shown in FIG. 1 is shown in the retracted position, in accordance with the present invention, with a cut-away view of the communication device.
Figure 3:
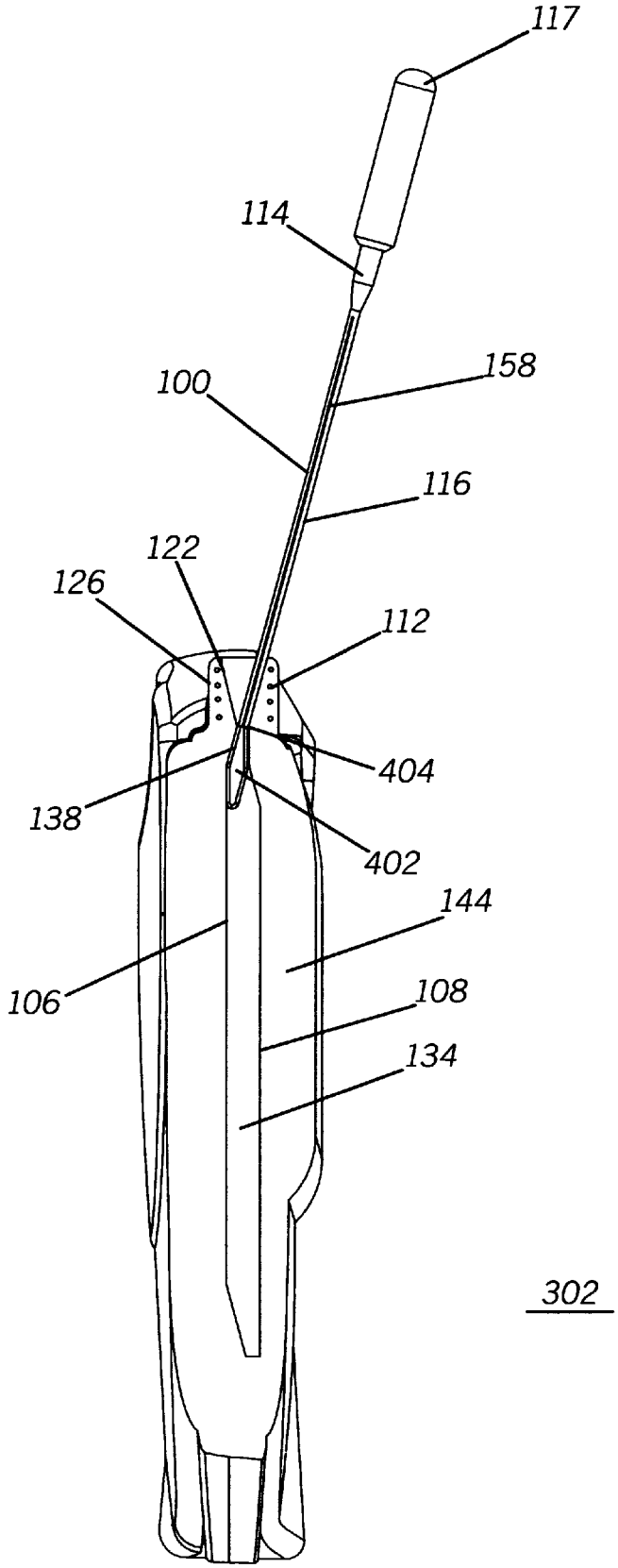
In FIG. 3 the same antenna assembly as shown in FIG. 1 in the slanted extended position, is shown in a cut-away view of the communication device to see the cavity 134 enclosed within, in accordance with the present invention.

In FIGS. 1–3, a communication device such as a radio or radiophone combination 302 utilizing the antenna assembly 100 of the present invention is shown. An improved mounting arrangement is taught by means of a specially designed stopper portion 402 of the antenna element 114 (see FIG. 9) and the correspondingly shaped housing support or antenna boss 126 having a tapered guide 138 (see FIG. 9) to control the antenna tilting (see FIG. 7).

Referring to FIGS. 1–5, there is shown an antenna assembly 100 in accordance with the present invention where the end tip or bottom portion of the antenna 402 (more simply seen in FIG. 9) and the antenna cavity 134 or housing 126 (more simply seen in FIG. 8) have uniquely designed angled internal contours for automatic tilting (more simply seen in FIG. 7) of the antenna to decrease antenna loading. The present invention allows the tilting of an extended antenna assembly 100 in FIGS. 1, 3, and 7 without externally molding the antenna boss or other housing support 126 at an angle and without requiring fancy mechanical interfaces. The antenna element 114 of the antenna assembly 100 will reside straight down inside the radio when retracted as seen in FIG. 2 and FIG. 6.

In FIG. 1, the external parts of the antenna housing 144 is seen as a vertical housing support section or an antenna boss 126. This boss 126 can be an integral part of the radio housing 144 or a separate part that can be assembled onto the radio housing 144. When the user pulls the antenna "up" from the antenna boss 126, the entire length of the antenna naturally pulls back, from the boss 126, at a preferable fifteen degree angle due to the shape of the antenna tip, base, or bottom portion 402 being confined by the internal shape of the antenna housing, whether the internal channeling of the housing is formed of the boss 126, the radio housing 144, the cavity 134, a combination or a separate part. This slanted position allows the antenna to stay away from the user's head to reduce loading effects in order to increase antenna efficiency while the user is using the communication device as a phone. When the antenna is pushed "down", most of the length of the antenna naturally retracts straight back into the communication device housing 144 without being bent.

Figure 4:
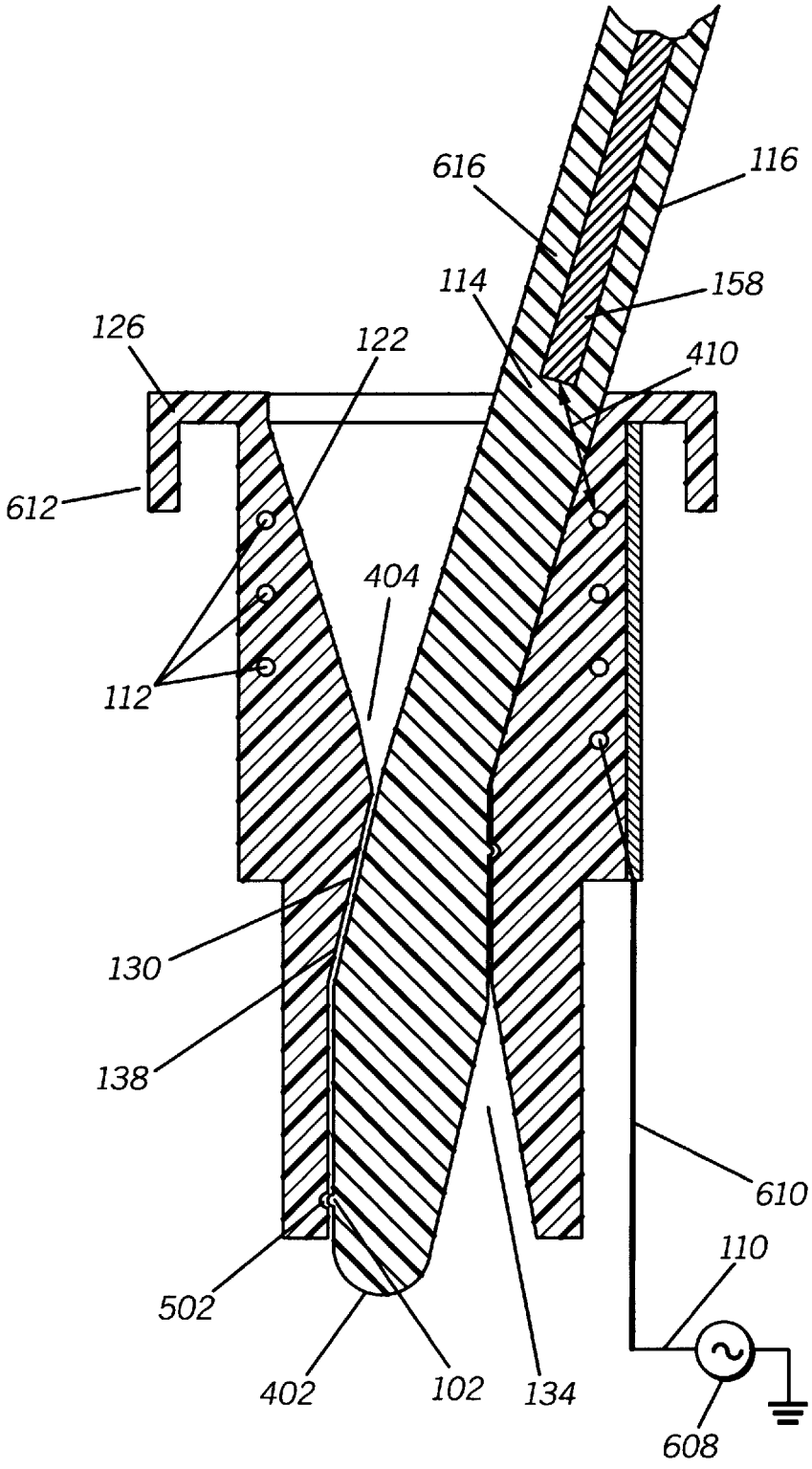
In FIG. 4 a simplified cross-sectional representation of the electromagnetic coupling within the same antenna topology of FIG. 6, is shown, in accordance with an alternate embodiment of the present invention.

Basically, referring to FIG. 3, in accordance with the teachings of the present invention, an antenna assembly 100 includes an antenna element 114 having an expanded base portion 402 and a linear portion 116. In FIG. 4, the expanded base portion 402 is made of plastic and in FIG. 5, the same numbered expanded base portion 402 is made of metal to show the different types of electrical antenna topology envisioned by the teachings of the present invention.

Referring back to FIG. 3, the linear portion 116 of the antenna includes a center conductor 158 electrically connected to an optional top helix 199 that is enclosed by the same dielectric coating of a top cap portion 117. Preferably, the center conductor 158 and the top helix 100 together form the antenna element or "whip" 114. The dielectric top portion 117 surrounds the top of the center conductor 158 to provide a safe "handle" for the user to pull out the antenna 114 from an antenna housing 144.

Depending on the electrical topology desired of a particular antenna application, the antenna housing 144 is a straw 134 made of plastic or metal or could simply be unrestricted space around the antenna, within a radio housing. If in the shape of a straw 134, the antenna housing 144 has a substantially linear passageway, defined by first 106 and second 108 opposed sides, and an angled tapered guide 138. The passageway has a first width wider than the widest portion of the angled tapered guide 138 to allow an antenna element 114 having an expanded base portion 402 and a linear portion 116 to retract the linear portion 116 vertically within the passageway and not be obstructed by the expanded base portion 402. Hence, for a vertical retraction and a slanted extension, the antenna element 114 is movable between a first slanted position wherein the antenna element 114 is inclined from the housing 144 when the expanded base portion 402 of the antenna element is positioned or otherwise stopped at the angled tapered guide 138 and a second retracted position substantially within the housing wherein the linear portion 116 of the antenna element 114 is retracted vertically within the housing 144.

The straw 134, cavity or sleeve 134 thus forms an inner or storage cavity for the linear portion 116 of the antenna element 114 in FIG. 2 to reside in and for the top cap portion 117 of the antenna to protrude from, when the antenna element 114 is in the retracted (second) position. In this retracted position, depending on the antenna topology desired, if a base coil 112 forms a fixed part of the antenna that is encapsulated within the antenna boss 126, a separate part, or as just the top portion of the radio housing surrounding the cavity 134 below, the optional top helix 199 can be made to electromagnetically couple with the base coil 112. Even though the coils 112 and 199 are similar, only a cut-section of the base coil 112 is represented to be able to show the helix 199 coupled within.

Referring back to the body section of the cavity 134 of FIG. 3 as a straw 134, at the top, the first side 106 of the cavity or straw inwardly tapers toward the center of the cavity or straw and away from the straight edge or a ninety degree vertical line at the preferable angle to form the tapered, slanted, canted, or angled side of the exit guide 138. The second side of the cavity 108 is spaced away from the first side 106 a greater distance than the maximum width of the exit guide 138. The opposed or second side of the exit guide 138 is a straight edge ninety degree aligned in a vertical line. The second wider side 108 of the cavity zigzags to the straight exit guide edge via an inwardly tapered edge that is fifteen degrees tilted away from the straight exit guide edge. Between the first side of the wider cavity portion 106 and the opposed second side 108 is found sufficient space to allow the antenna to retract freely and for the wider stopper portion 402 to shift position inside the cavity.

To mount or otherwise secure the antenna in place at the slanted position, the shape of the angled or tapered exit guide 138 of the base coilhousing or bottom cavity 134 may or may not correspond snugly to the expanded base portion 402 of the antenna whip. The top of the expanded base portion 402 may be straight or a substantially top triangular portion of a parallelogram, a trapezoid, a rhombus, or any other configuration having a straight side and an opposed slanted side for forming an inverted "V" acute angle of approximately seven-to-fifteen degrees. This expanded base portion 402 in conjunction with 138 serves as a stopper for the center conductor 158 to stabilize the linear portion 116 of the antenna at the desired angle off-center mounting arrangement. The slanted antenna at its fully extended position is stopped by the wider stopper portion 402 of the antenna from exiting a smaller bottom constricted terminus 404 between a conical aperture 122 and the exit guide 138 of the antenna cavity 134.

Figure 9:
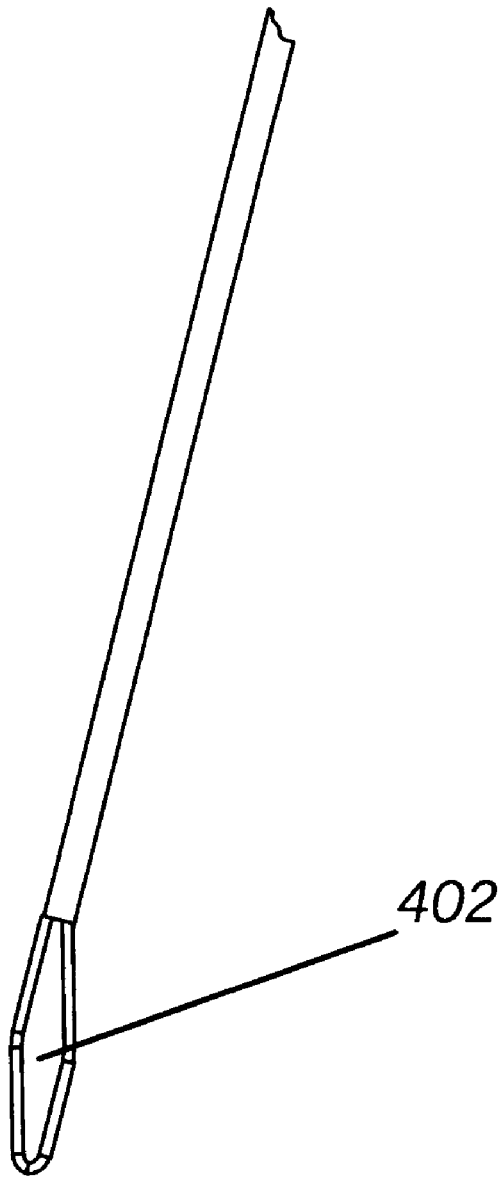
In FIG. 9 the same antenna stopper portion 402, as shown in FIG. 6, is shown in a simplified side view to see the correspondence with the tapered guide 138 enclosed within the housing support section 126 of FIG. 8, in accordance with the present invention.
Figure 10:
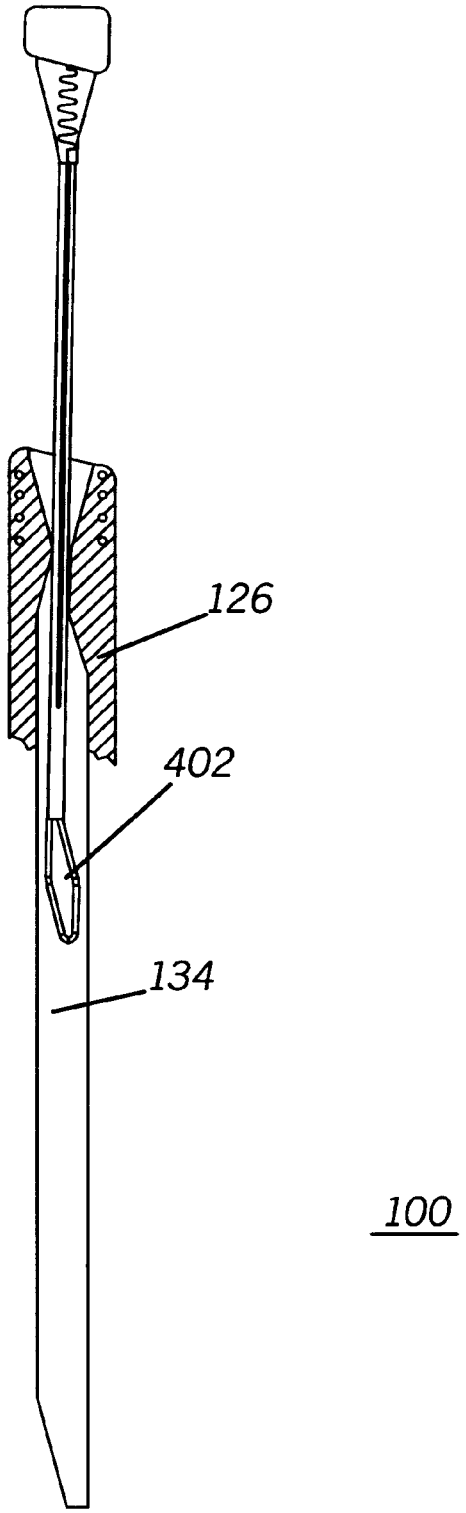
In FIG. 10 the same antenna assembly as shown in FIG. 6 is shown, in accordance with the present invention, in the transitional state between the slanted extended position of FIG. 7 and the retracted position of FIG. 6.

As an additional advantage of the invention, by using a material having sufficient elasticity, such as rubber, for the constricted terminus 404, the antenna 114 can be slipped out and back in of the terminus, for use as a stylus (removed as seen in FIG. 9) for a touch-screen application of the radiophone.

The optionally tapered bottom end of the stopper 402 help form the parallelogram or trapezoidal shape and aid in the antenna's sliding movement "up" and "down" the cavity 134. Preferably, the stopper 402 is substantially a rhombus being an equilateral parallelogram with oblique or acute angles. Since for simplicity, the stopper 402 is shown and designed as a linear parallelogram, rhombus or diamond, the corresponding cavity 134 has substantially linear sides. However, if the stopper 402 was designed as a parallelogram with curvilinear edges, the corresponding cavity 134 can be a substantially cylindrical type of cavity.

Referring first to FIG. 3 and then to FIG. 2, the antenna may have its first top side of its diamond shaped stopper 402 stopped at the slanted angle position from the vertical reference or just straight stopper. The antenna element 114 reaches its maximum height when the antenna bottom portion 402 presses against the constricted top of the exit guide 138 and is stopped from protruding further.

As the antenna retracts down from the slanted position of FIG. 3, this first top side of the stopper 402 slides vertically down at a ninety degree position touching initially the first side 106 of the cavity. When the antenna shifts alignment as it rounds, pivots, or turns the seventy-five degree "corner", the cavity has enough space or width such that the antenna's second bottom side of its diamond shaped stopper 402, initially stopped at the same seventy five degree angle can vertically re-align with and/or touches the second opposed straight side 108 of the wider cavity portion, as the antenna straightens out within the cavity 138 in FIG. 2.

Referring to FIG. 2, the same antenna assembly as shown in FIG. 3 is shown, this time in the retracted or down (second) position in accordance with the present invention. The minimum width of the cavity 134 is the maximum width of the stopper antenna section 402 and of the correspondingly shaped exit guide cavity section 138. On the other hand, the maximum width of the cavity 134 is the horizontal distance projected by the length of the antenna element 114 as the hypotenuse of a right triangle where the shorter horizontal side forming the right angle of this triangle is the maximum length or distance allowable for the cavity width. When looking at an antenna slanted away from a user's head at the left, the antenna element 114, longer than the cavity width, is thus designed to force the left obtuse angle of the rhombic stopper 402 to pivot or otherwise turn as the antenna element 114 and the top left side of the rhombic stopper 402 straightens out to fit inside the cavity 134.

Figure 5:
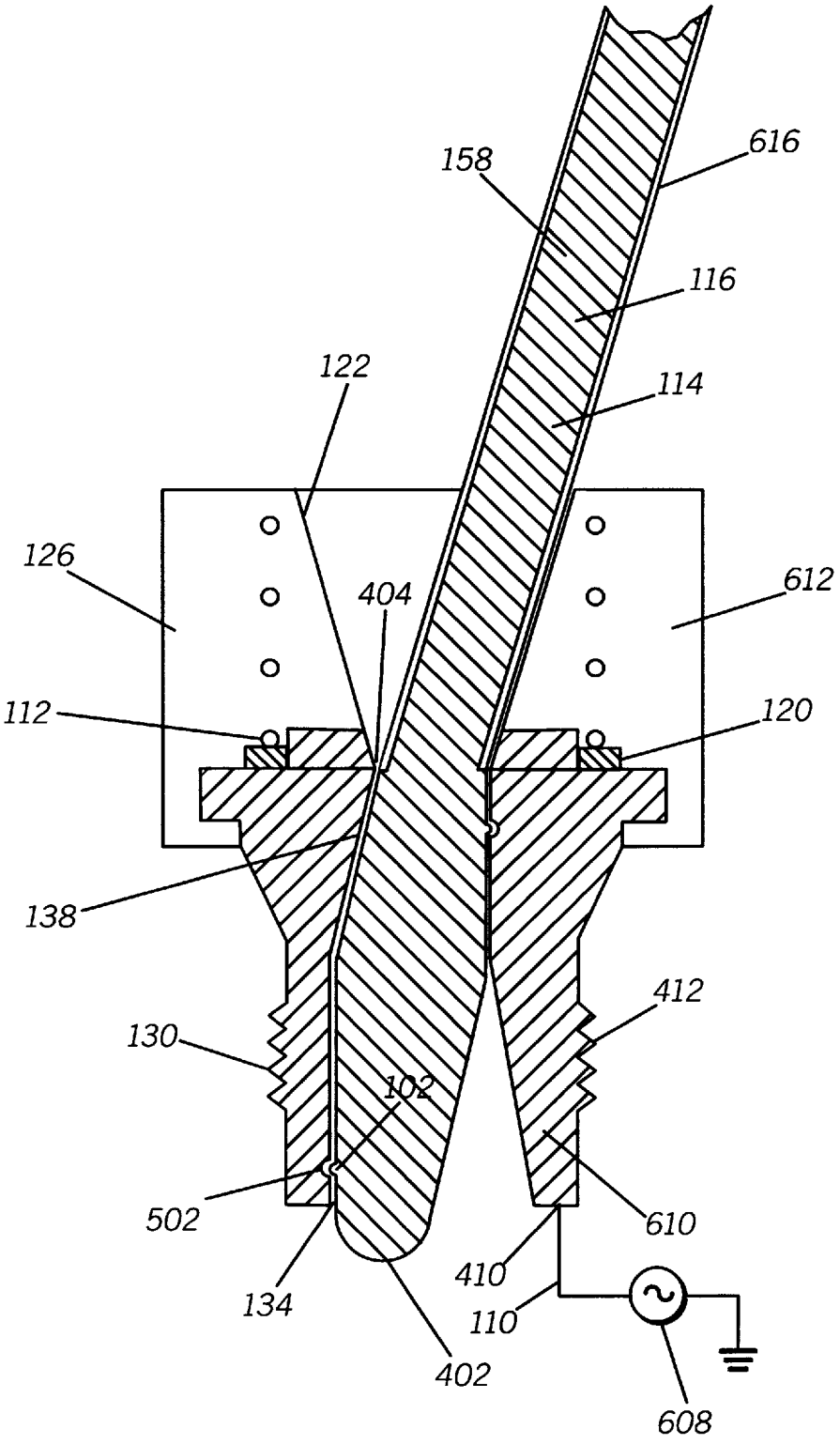
In FIG. 5 a simplified cross-sectional representation of the non-electromagnetic coupling within the antenna topology of FIG. 2, is shown, in accordance with the present invention.
Figure 6:
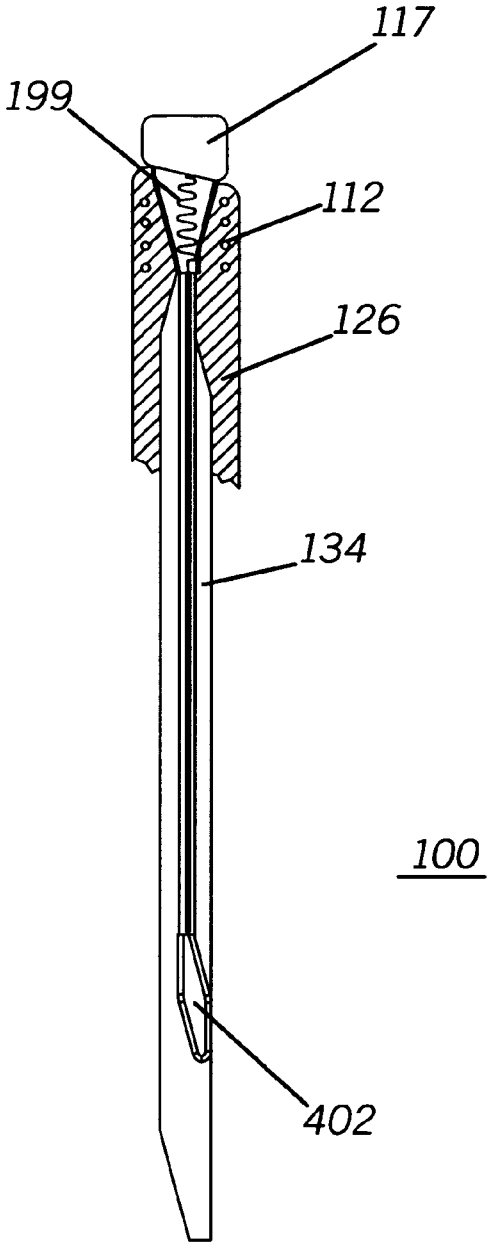
In FIG. 6 an antenna assembly having an alternate embodiment, in accordance with the present invention, is shown in the retracted position.

Optionally, the bottom portion of the antenna housing or cavity 134 includes at least one snap, spring or detent 102 in FIGS. 4 and 5 which helps bias, latches or otherwise retains the antenna element 114 upwardly when antenna element 114 is slid-up from the retracted (second) position. The snap 102 gives the radio user a slight audio or tactile indication when the user pulls the antenna element 114 out from the cavity 134 to place the antenna element in the first position, since the snap 102 pushes a top portion 116 above an internal portion of the antenna boss or other housing support section 126 for the snap 102 to be latched or otherwise captured onto a corresponding retention area, recess, or slot 502. The snap 102 can be any resilient member such as a rubber, plastic or a spring member which can provide upward bias to antenna element 114 while capturing it in place. Snaps 102 can be made from a suitable material such as resilient rubber, a spring, foam, etc. Preferably, the snap 102 can be friction fit within the corresponding diameter of the retention area or slot 502 of the cavity 134, the coil support 130, or any other cavity or sleeve portion.

A housing having an angled tapered guide 138 to constrict the movement of the expanded base portion 402 of the antenna is an important feature of the teachings of the present invention, regardless of whether or not the housing with the guide 138 is connected to a cavity or space below. Any structure constricting the movement of the expanded base portion 402 is contemplated by the invention. Hence, any part of the antenna boss or housing support section 126 or a separate portion inside the boss 126, such as a coil support or other feedpoint mounting area 130 can be shaped to provide the angled tapered guide 138.

The bottom portion 402 engages the coil support 130 which help to maintain the antenna 114 in the first or extended position, when the antenna 114 is pulled up from the storage cavity 134 of the housing 144. Antenna element 114 reaches its maximum height when the antenna bottom portion 402 presses against the side portion of the coil support 130. The inner center conductor 158 of the antenna element 114 is preferably a rod manufactured from an electrical conductive material such as Nickel Titanium, aluminum or other similar metal which is easily extruded into a cylindrical shape. Although nylon is the preferred material for the dielectric, other similar materials may be utilized for the insulation in the form of a plastic overmold 616 over the center conductor 158.

The coil support 130 may be a non-metallic plastic part of the radio housing, the antenna boss 126 of FIG. 1 or it can be a separate screw-in metal fitting 412 of FIG. 5 for fastening to the top of the radio housing or boss, depending on the electromagnetic type of antennas used. Radio 302 includes a conventional receiver (not shown) and transmitter 608 which are selectively coupled to the antenna assembly 100 via an antenna switch (not shown) which is in turn coupled to a base coil tail wire or end termination 610 via a common antenna feed interface in the form of an RF cable 110 of FIGS. 4 and 5. In the case of a screw-in base coil such as the one shown in FIG. 5, the metal fitting screw 412 is soldered (120) to a base coil 112 as the coil support 130 to make a single part. The single coil support fitting 130 screws onto the radio housing via a metal bushing (not shown) which is sonic-welded into the radio housing and connected electrically to the communication device's radio frequency (RF) circuitry. The single-piece coil support 130 thus includes the threaded portion 412 on the bottom portion of the coil support which can thread into the cavity 134 of the radio housing. Antenna feedpoint 410 is the location at the bottom of the metal fitting 412 which is soldered to the base coil 112 on top, where the metal fitting 412 is attached (e.g. soldered, mechanically fastened, etc.) to the RF cable 110.

For the metal fitting of FIG. 5, the detent 102 is preferably designed as a set of compressible metal fingers as known in the art, which forces a friction fit with the bottom portion 402 of antenna 114, when antenna 114 is in the first or active position ("up" position). The "up" position is maintained by expanding and the lowering to the "down" position is achieved by contracting the metal fingers. The metal coil support 130 is thus electrically coupled to antenna feedpoint 410 and to the transmitter 608. In the "up" or extended position of FIGS. 5 and 3, the single piece metal fitting coil support 130 and the soldered base coil 112 constantly make contact with the antenna element 114. While in the "down" or retracted position of FIG. 2, the base coil 112 is the only active antenna element when the conductor 158 resides inside the cavity 134 and the stopper 402 is grounded to the radio main ground via conventional metal clips. Since the bottom antenna portion 402 is metallic and no top helix exists within the plastic top cap section, the integral support section 126 and coil support 130 are the only antenna components connected to the rest of the RF circuitry through the RF cable 110 in FIG. 5. In this "down" retracted position of FIG. 2, the antenna element 114 itself, is not in electrical contact with the transmitter and/or receiver section 608 of the communication device of FIG. 5, and only the fixed base coil 112 is connected.

Figure 7:
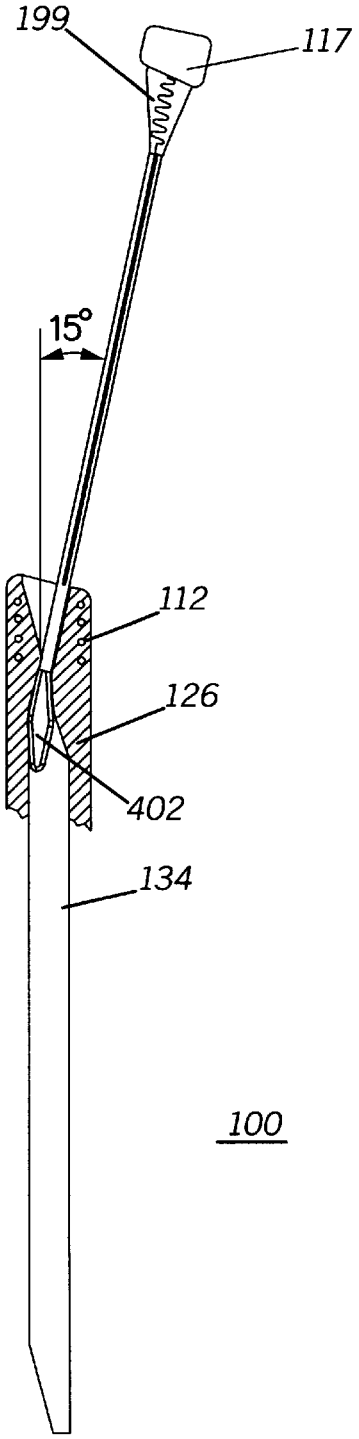
In FIG. 7 the same antenna assembly as shown in FIG. 6 is shown, in accordance with the present invention, in the slanted extended position.

In FIGS. 4, 6, and 7, showing the magnified area of interest, for one antenna topology, in accordance to the teachings of the present invention, a base linear feedpoint portion, within the antenna boss or support section 126, connects or otherwise interfaces the expanded base portion 402 and the linear portion 116. In the first slanted position of FIG. 4, the antenna element 114 forms an active antenna portion with the base linear feedpoint portion coupled to the antenna feedpoint 410 at the feedpoint end of the antenna housing 144. The base linear feedpoint portion is electromagnetically coupled to the coil 112 and the antenna element 114 is playing an active antenna part, when the center conductor antenna element 158 is in the slanted "up" position of FIG. 7. If the bottom antenna portion 402 is plastic as in FIG. 4 and the top helix 199 is present, as in FIG. 6, in its "down" retracted position, the top helix 199 of the antenna element 114 is electromagnetically coupled with the base coil 112 for making electrical contact, through the base coil 112, with the transmitter and/or receiver section 608 of the communication device while the rest of the linear portion 116 of the antenna element 114 is transparently "hidden" and non-active within the cavity 134 or other space of the radio housing 144.

In FIGS. 4 and 5, the internal electrical and mechanical features of variations of different antenna topologies fulfilling the external antenna mounting arrangement of FIG. 1 are highlighted. The antenna assembly 100 includes the base inductor coil or helix 112 as a fixed active antenna portion for electrical connection to a communication device's transmitter/receiver 608. The coil 112 is preferably protected by the coil support 130. Attached to the base inductor coil 112, within the rest of the communication device housing 144, is a metal line or base coil tail wire in FIG. 4 and a metal fitting in FIG. 5 for forming an end termination 610 for the base coil 112. This end termination 610 electrically connects the base coil 112 to the transmitter and receiver section 608. In FIG. 4, the end termination 610 is preferably made from metal to form a base coil feed launch for the coil or helix 112.

Figure 8:
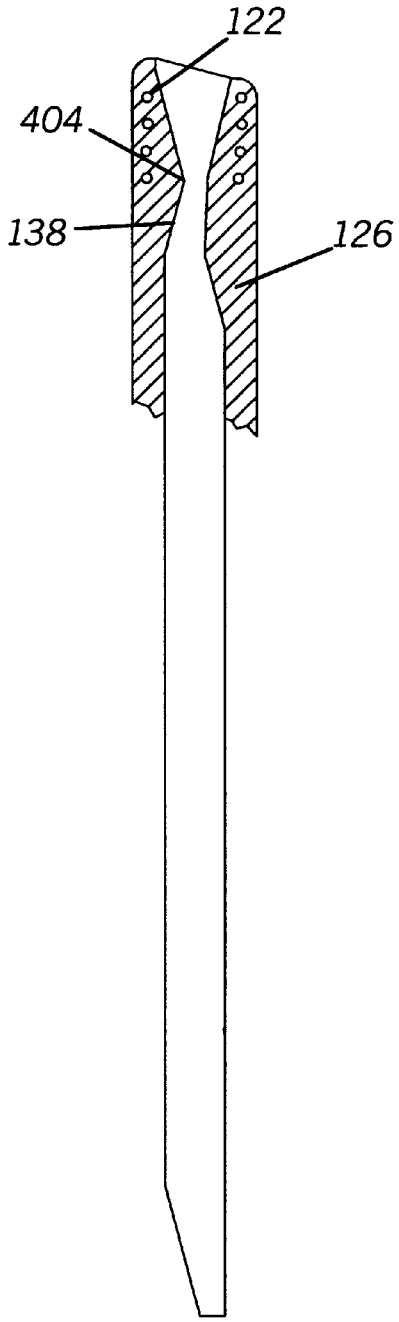
In FIG. 8 the same housing support section 126, as shown in FIG. 6, is shown in a cut-away simplified view to see the tapered guide 138 enclosed within, in accordance with the present invention.

For better clarity in FIGS. 3–5, the base coil 112 is exaggerated in appearance and in actuality may be much smaller for fitting around, as in FIG. 5, or within, as in FIG. 4, the base of a conical housing support section or antenna boss 126. The outer housing of the base inductor coil 112 forms the support section 126 which includes a conical aperture 122. FIGS. 6 and 8 show an alternate embodiment of this top conical aperture 122 of the support housing 126 that is optionally further angled or otherwise sloped down at its top edges to more securely rest a correspondingly angled top antenna cap section 117. This conical aperture 122 is used to rest the plastic overmolded center conductor 158 of an antenna element 114 when the antenna element is protruding at an incline or otherwise slanted from the support section 126. In this slanted position, the antenna element 114 forms an extended whip that preferably rests against the antenna support section 126 of the radio housing. The antenna element 114 utilizes the longer linear top portion 116 as an active whip antenna in the slanted position of both FIGS. 4 and 5.

The base inductor coil 112 also includes an insulator 612 (for forming the dielectric coil support 130 of FIG. 4) and the center conductor 158 similarly includes a thin layer of overmolding insulation 616, such as a conventional low loss insulator as known in the art, in order to insulate the center conductor 158 from "shorting" to the base inductor coil 112 near the feedpoint. Instead of a separate base coil part 112, the insulator 612 may be molded plastic for encapsulating the base coil 112 and for integrally forming the support section or antenna boss 126 having the conical aperture 122 as a single portion of the radio housing. Serving as the feedpoint, the top of the base inductor coil 112 is electromagnetically coupled to the center conductor 158 at a desired separation created for the correct coupling between the two elements of the coil 112 and conductor 158 such that energy is transferred between them in FIG. 4. In the coupled antenna topology of FIG. 4, the feedpoint is at a desired decoupling distance 410 for the base coil feed launch 610 to capacitively couple the electromagnetic energy from the base coil 112 to the center conductor 158. In FIG. 4, any antenna which is connected or otherwise coupled to the base inductor coil 112 will automatically be electrically connected to the antenna feedpoint 410 which will then be coupled to the appropriate receiver and transmitter sections 608 by RF cable 110 which will be found inside of the radio itself.

Preferably, the length of the base antenna coil 112 is designed as an ideal quarter wavelength λ\4 stub at the desired operating frequency in FIG. 5 and in wavelengths greater than or less than a quarter wavelength in FIG. 4. For example, base coil 112 could be designed as a ⅝ stub at the desired operating frequency in FIG. 5 and in wavelengths greater than or less or of any other practical size, other than a quarter wavelength in FIG. 4. The length of the center conductor rod 158 of the antenna element 114 is preferably designed for a half-wavelength (λ\2) at the desired operating frequency in FIG. 4 and various resonating wavelengths of multiples of λ\4 or λ\2. Also, antenna element 114 can be designed as a single piece element, a telescoping antenna element, or other suitable types.

Viewing all the FIGS. 1–10. together to gain an overall electrically and deeper operational understanding, the antenna assembly basically has two operating positions: extended and retracted. In both cases, a portion of the antenna assembly, made of a retractable part, in the form of a linear antenna element 114, and/or a fixed base coil 112, is active at any one time, depending on the antenna topology selected.

Referring to FIG. 4, the antenna topology represented is a coupled design. A base coil 112 is placed inside the radio housing and is secured by either a bushing or some other mechanical snap-in features (not shown). The retractable part or the antenna element 114 is composed of the straight or linear section 116 made of a conductive material such as Nickel Titanium (NiTi), forming a center conductive rod 158, and a top helix 199 enclosed in a dielectric molded material on within the top cap section 117 of the antenna of FIG. 7. Both the center conductor 158 and the top helix 199 are connected to each other at all times to form the antenna element 114. The NiTi rod 158 is also covered with an extruded coating of Polyurethane or similar dielectric material. The overall electrical length of the antenna element 114 is designed to be a half-wavelength or longer at the desired frequency of operation. The base coil 112 is inserted inside the housing and protected by the antenna boss 126. The base coil 112, similarly constructed as the top helix 199 of FIG. 7, is basically a molded helix with a pre-set number of turns and pitch depending the frequency of operation. The electrical length of the base helix is preferably not an exact multiple of a quarter-wave, but close to it, as in about a third of a wavelength or 0.22 (λ\3) depending on the actual radio ergonomics. Below the base coil 112 but still part of the same antenna boss 126 structure is the angled tapered guide 138 serving as the constricted interface to the cavity or other form of space 134 below. This guide portion 138 of the boss 126 houses the trapezoidal stopper 402 when the antenna element 114 is in the extended position as in FIG. 7. The RF contact between the radio transmitter and receiver is achieved via a portion 610 of the helix or base coil 112 protruding out of the coil support 130 and going straight down and making contact to the RF cable 110 via some mechanical interface (not shown) commonly used in this field. The base coil 112 provides the impedance transformation and allows the RF energy to be coupled to the antenna element 114 via a feedpoint coupling distance 410. This distance must be carefully measured and the rule of thumb is to have it inside the top half of the helix or base coil 112 and no more than 3.5 mm above the base coil 115. This set-up will create an overall coupling effect, which has proven to improve antenna efficiency considerably.

When the antenna topology of FIG. 4 is retracted, as in FIG. 6, the top base coil 199 within the top cap 117, resides inside the base coil 112. The two helices 112 and 199 will overlap somewhat. This overlap is determined only at the time of actual construction and testing and it is strictly depended on the real-life radio printed circuit board (PCB) ground layout and dimensions. In the retracted state of FIG. 6, the NiTi rod antenna section or center conductor 158 will reside inside the plastic or metal straw 134 or other space 134 inside the housing 144. In the case of a metal straw 134 serving as the cavity 134, the metal straw 134 is optionally grounded to the PCB main ground in order to reduce electromagnetic interferences (EMI) and also to improve matching for the "down" or retracted antenna element 114 of FIG. 6.

Referring to FIG. 5, the case of a non-coupled antenna topology is represented. The base coil 112 does not need to reside inside the radio housing, but within a separate antenna boss attachment 126 for mating with the radio housing. Basically, the separate boss attachment 126 containing the base coil 112 is made of two sections. One being the exposed metal screw portion 412 for serving as the coil support 130. This screw portion 412 of the boss attachment 126 also serves as the coil end termination 610 to act as the feed to the base coil or helix 112 soldered (120) to the metal screw 412 at the bottom. The helix 112 is then molded with a dielectric coating 612 with specific electrical parameters. Namely, the dielectric constant preferably does not exceed a value of 3.6 and has a loss tangent not greater than 0.001.

To electrically mate with the metal fitting 412 of FIG. 5, the trapezoidal stopper 402 must also be metallic. When the antenna element 114 is extended in FIG. 3, only the linear portion 116 is active while the helix or base coil 112 is short circuited (electromagnetically by killing its magnetic B flux) through the metallic stopper 402 captured by the metal fitting 412 below the coil's soldered connection 120.

However, when the antenna element 114 is retracted in FIG. 2, the only part of the antenna assembly active is now the base coil helix 112 since only the plastic top portion of the antenna element 117, without an inner top helix, will be within the base coil 112. The conductive portion 158, below the top plastic cap 117, forming the retractable portion of the antenna element 114 will reside inside the housing and below the base coil 112. This conductive portion 158 will reside inside either a metal or a plastic straw 134 or in other space 134, within the housing. If the straw 134 is metal, then the straw 134 is not physically connected or otherwise electrically connected to the metal fitting 412 above to prevent shorting of the base coil 112.

In summary, a parallelogram or more specifically, a rhombus shaped base or bottom feature with fifteen degree parallel edges is molded to the bottom end of the antenna. The internal antenna cavity of the plastic communication housing is shaped also with a corresponding fifteen degree angle to serve as a guiding feature for the antenna. When the base or bottom of the antenna and the guiding feature of the antenna housing are aligned, the antenna will naturally tilt back at the desired fifteen degree or any other pre-defined angle.

What is claimed is:

1. An antenna assembly, comprising:

a housing having an angled tapered guide; and an antenna element having an expanded base portion and a linear portion, the antenna element being movable between a slanted position wherein the antenna element is inclined from the housing and the expanded base portion of the antenna element is blocked at the angled tapered guide and a vertical position substantially within the housing wherein the antenna element is vertically retracted within the housing.

2. An antenna assembly, comprising:

a housing having a cavity aligned in a first axis and a base helix antenna with angled constricted exit guide surrounding the top of the cavity; and an antenna element carried by the housing, the antenna element having a linear portion and an expanded bottom angled stopper portion corresponding to a portion of the shape of the angled constricted exit guide, the antenna element being movable between a first position wherein the linear portion is aligned in a second axis in response to the angled constricted exit guide forcing the expanded bottom angled stopper portion of the antenna element to pivot at the angled constricted exit guide as the antenna element is extended, and a second position substantially retracted within the housing wherein the linear portion is aligned in the first axis in response to the linear portion of the antenna element extended in the second axis forcing the expanded bottom angled stopper portion of the antenna element to pivot below the angled constricted exit guide as the linear element is constricted from retracting in the first axis.

3. The antenna assembly of claim 2, wherein the housing includes a fixed active antenna portion with the angled constricted exit guide surrounding the top of the cavity.

4. The antenna assembly of claim 3, wherein the fixed active antenna portion comprises a first helical base coil coupled to the antenna element when the antenna element is in the first position.

5. The antenna assembly of claim 4, wherein the antenna element is approximately a half-wave or quarter-wave length antenna element when in the first position.

6. The antenna assembly of claim 5, further comprising a cap portion protruding substantially vertically from the helix base coil when the antenna element is in the second position.

7. The antenna assembly of claim 3, wherein the fixed active antenna portion is a helix.

8. The antenna assembly of claim 2, wherein the expanded bottom angled stopper portion of the antenna element is substantially a parallelogram or a straight rod.

9. The antenna assembly of claim 2, wherein the angled constricted exit guide of the base coil cavity has a first side aligned in the second axis and a second opposed side aligned in the first axis.

10. The antenna assembly of claim 9, wherein the first side and the second opposed side of the angled constricted exit guide forms approximately a seven-to-fifteen degree angle between the second axis and the first axis.

11. The antenna assembly of claim 2, wherein the expanded bottom angled stopper portion of the antenna element is substantially a rhombus.

12. The antenna assembly of claim 4, wherein the angled constricted exit guide of the helix base coil comprises a funnel having a wider angled mouth and a smaller shaft, wherein the wider angled mouth encapsulates the first helical coil to provide a coil support and the smaller shaft has a first side aligned in the second axis and a second opposed side aligned in the first axis for forming the angled constricted exit guide.

13. The antenna assembly of claim 12, wherein the first side and the second opposed side of the angled constricted exit guide forms approximately a seven-to-fifteen degree angle between the second axis and the first axis.

14. The antenna assembly of claim 13, wherein the cavity has a first straight side forming an angle with the first side of the angled constricted exit guide for vertically aligning the antenna element.

15. The antenna assembly of claim 14, wherein the cavity has an opposed second straight side spaced apart from the first straight side at a distance greater than the wider angled mouth.

16. The antenna assembly of claim 15, wherein the opposed second straight side has a tapered edge forming an angle with the second opposed side of the angled constricted exit guide.

17. The antenna assembly of claim 2, wherein the angled constricted exit guide comprises an acute aperture forming an inverted "V" acute angle having a straight side and an opposed slanted side or a straight section.

18. The antenna assembly of claim 2, wherein the angled constricted exit guide comprises an acute aperture forming an inverted "V" acute angle of approximately seven-to-fifteen degrees.

19. A communication device, comprising:

transmitter; and an antenna assembly coupled to the transmitter, the antenna assembly including:

a housing having an angled tapered guide; and an antenna element having an expanded base portion and a linear portion, the antenna element being movable between a slanted position wherein the antenna element is inclined from the housing and the expanded base portion of the antenna element is blocked at the angled tapered guide and a vertical position substantially within the housing wherein the antenna element is vertically retracted within the housing.

* * * * *